US010578340B2

(12) United States Patent
Haefner et al.

(10) Patent No.: US 10,578,340 B2
(45) Date of Patent: Mar. 3, 2020

(54) VEHICLE HEATER

(71) Applicant: Eberspächer Climate Control Systems GmbH & Co. KG, Esslingen (DE)

(72) Inventors: Michael Haefner, Stuttgart (DE); Andreas Collmer, Aichwald (DE); Hermann Eppler, Balingen (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 80 days.

(21) Appl. No.: 15/138,709

(22) Filed: Apr. 26, 2016

(65) Prior Publication Data

US 2016/0318374 A1 Nov. 3, 2016

(30) Foreign Application Priority Data

Apr. 29, 2015 (DE) ..... 10 2015 106 600

(51) Int. Cl.
*B60H 1/22* (2006.01)
*F24H 3/06* (2006.01)

(52) U.S. Cl.
CPC ... *F24H 3/065* (2013.01); *F23D 2900/21002* (2013.01); *F23N 2041/14* (2013.01)

(58) Field of Classification Search
USPC ..... 237/12.3 C; 277/639
See application file for complete search history.

(56) References Cited

U.S. PATENT DOCUMENTS

RE24,065 E * 10/1955 Bergstrom ..... F16B 37/043 277/636
3,758,179 A * 9/1973 Smith ..... F16J 15/348 277/384
5,096,325 A * 3/1992 Udagawa ..... B23P 19/042 277/598
7,182,574 B2 * 2/2007 Lyons ..... F04D 29/4226 403/12
7,270,098 B2 * 9/2007 Young ..... B60H 1/2206 123/142.5 R
7,753,633 B2 * 7/2010 Genick, II ..... F16B 5/025 411/369
8,910,881 B2 * 12/2014 Ludwig ..... B60H 1/2212 237/12.3 A (Continued)

FOREIGN PATENT DOCUMENTS

DE 88 00 117 U1 3/1988
DE 88 00 117 U1 4/1988

(Continued)

OTHER PUBLICATIONS

Chinese Office Action dated Oct. 26, 2017 with English translation.

*Primary Examiner* — Steven B McAllister
*Assistant Examiner* — John E Bargero
(74) *Attorney, Agent, or Firm* — McGlew and Tuttle, P.C.

(57) ABSTRACT

A vehicle heater includes a heat exchanger assembly unit (10) and a blower assembly unit (38). The heat exchanger assembly unit (10) has a first sealing surface (28) and the blower assembly unit (38) includes a second sealing surface (50), which is positioned opposite the first sealing surface (28) at a predefined location determined by the spacer arrangement (34). A sealing element (60) is clamped in between the first sealing surface (28) and the second sealing surface (50).

10 Claims, 4 Drawing Sheets

(56) References Cited

U.S. PATENT DOCUMENTS

2014/0217189 A1* 8/2014 Haefner ..... B60H 1/2203
237/44

FOREIGN PATENT DOCUMENTS

| | | | |
|---|---|---|---|
| DE | 100 58 794 | A1 | 6/2002 |
| DE | 20 2004 015 442 | U1 | 2/2006 |
| DE | 10 2005 053514 | A1 | 7/2006 |
| DE | 10 2013 002046 | B3 | 2/2014 |
| DE | 10 2013 102358 | A1 | 9/2014 |
| DE | 100 58 794 | A1 | 9/2014 |

* cited by examiner

VEHICLE HEATER

CROSS REFERENCE TO RELATED APPLICATIONS

This application claims the benefit of priority under 35 U.S.C. § 119 of German Patent Application 10 2015 106 600.9 filed Apr. 29, 2015, the entire contents of which are incorporated herein by reference.

FIELD OF THE INVENTION

The present invention pertains to a vehicle heater, which can be used, for example, to heat the air to be fed into the interior space of a vehicle.

BACKGROUND OF THE INVENTION

DE 20 2004 015 442 U1 shows an air heater for a vehicle, in which a heat exchanger assembly unit is connected to a blower assembly unit in the area of sealing surfaces located opposite each other. The heat exchanger assembly unit comprises a heat exchanger housing, which is made, for example, of a cast metallic material. The heat exchanger housing has a combustion chamber assembly unit mounting space, in which a combustion chamber assembly unit to be fed with combustion air and fuel can be accommodated. The combustion waste gases generated during the combustion in the combustion chamber assembly unit flow into a heat exchanger area, which follows the combustion chamber assembly unit mounting space and which has heat transfer ribs enlarging the heat transfer surface on both its inner side for thermal interaction with the combustion waste gases and its outer side for thermal interaction with the air to be heated.

The blower assembly unit comprises a blower housing, which carries or accommodates a blower motor on its side facing away from the heat exchanger assembly unit and has a delivery channel, which is open in the direction of an axis of rotation of a delivery wheel and surrounds the axis of rotation of the delivery wheel in a ring-shaped manner on its side facing the heat exchanger assembly unit. The delivery wheel covers the delivery channel and is located essentially in the combustion chamber assembly unit mounting space of the heat exchanger housing, which said mounting space also accommodates the combustion chamber assembly unit. The blower assembly unit designed in the manner of a side channel blower delivers the air necessary for the combustion into the combustion chamber assembly unit mounting space and consequently in the direction of the combustion chamber assembly unit.

To produce a tight connection of the combustion chamber assembly unit to the heat exchanger assembly unit, sealing surfaces of these assembly units are located opposite each other via the intermediary of a sealing element. These two housings are braced against one another via the intermediary of the sealing element by a plurality of bolts connecting the blower housing to the heat exchanger housing. In general, thin sealing elements consisting of a comparatively hard material, for example, rubber-coated metal seals, are inserted in the area between the blower assembly unit and the heat exchanger assembly unit. Since the delivery wheel is positioned in the blower assembly unit at a very short distance above the blower housing having the delivery channel, it is necessary to manufacture the blower housing with high precision. To avoid generating a deformation of the blower housing, which is made, for example, of an aluminum material, when assembling the blower housing with the heat exchanger housing via the intermediary of the sealing element, the two sealing surfaces, which are positioned opposite each other via the intermediary of the sealing element and are pressed against one another, also must be provided with correspondingly high precision. This is achieved, in general, by subjecting the blower housing in its area covered by the delivery wheel and in the area of the sealing surface provided thereon and the heat exchanger housing in the area of the sealing surface provided thereon to a finishing operation by machining.

SUMMARY OF THE INVENTION

An object of the present invention is to provide a vehicle heater, which has a simple design and has a tight connection of a blower assembly unit to a heat exchanger assembly unit.

This object is accomplished according to the present invention by a vehicle heater, comprising a heat exchanger assembly unit and a blower assembly unit, wherein the heat exchanger assembly unit has a first sealing surface and the blower assembly unit has a second sealing surface positioned opposite the first sealing surface at a predefined distance by means of a spacer arrangement, further comprising a sealing element clamped between the first sealing surface and the second sealing surface.

It is ensured in the design according to the present invention by providing the spacer arrangement provided in addition to the sealing element that independently from the design of the sealing element, the sealing surfaces at the blower assembly unit and the heat exchanger assembly unit are always located at a defined distance from one another. This ensures, on the one hand, that a sealing element positioned between them is subject to a defined load. On the other hand, high precision can be dispensed with in the manufacture of the sealing surfaces, because the sealing surfaces do not have to be pressed against one another over their full surface via the intermediary of a hard sealing element, but the spacer arrangement defines the relative position of the blower assembly unit in relation to the heat exchanger assembly unit without this leading to the risk of a deformation especially in the area of the blower assembly unit.

Since the heat exchanger assembly unit and the blower assembly unit are, in general, positioned opposite each other with respective end faces, it is proposed, furthermore, that the first sealing surface be provided on an end face of a heat exchanger housing of the heat exchanger assembly unit and that the second sealing surface be provided on an end face of the blower assembly unit.

To make it possible to close the space area into which the air being delivered through the blower assembly unit flows sufficiently tightly, it is proposed that the first sealing surface, the second sealing surface and the sealing element have ring-shaped configurations.

Especially if the heat exchanger assembly unit or the blower assembly unit with the respective housings are manufactured from cast metallic material, provisions may be made according to another advantageous aspect for the spacer arrangement to comprise, preferably at the heat exchanger assembly unit only, at the heat exchanger assembly unit or/and at the blower assembly unit a plurality of, preferably three spacer projections projecting over the sealing surface provided thereon. The spacer projections may be provided as integral parts of the respective assembly unit. As an alternative, it is also possible to integrate spacer projections provided as separate components. The provision of three spacer projections has the essential advantage that, on the one hand, a permanent connection distributed over the circumference can be established thereby between the blower assembly unit and the heat exchanger assembly unit. On the other hand, the risk of deformation especially of the blower assembly unit is avoided by the provision of three mutual contact points.

It is proposed for the permanent connection of the blower assembly unit to the heat exchanger assembly unit that a fastening member meshing opening for meshing a fastening member fixing the blower assembly unit at the heat exchanger assembly unit be provided in the area of at least and preferably each spacer projection.

Especially if the spacer projections are provided at the heat exchanger assembly unit, a relative position of the two sealing surfaces, which loads the sealing element in a defined manner, relative to one another can be achieved with a simple design by the blower assembly unit having a sealing/contact end face providing the second sealing surface and a contact surface for each spacer projection.

To make it possible to preset a defined positioning of the sealing element during the assembly of the blower assembly unit with the heat exchanger assembly unit, it is proposed that a sealing element positioning formation be provided at the heat exchanger assembly unit or/and at the blower assembly unit. For example, the sealing element positioning formation at the heat exchanger assembly unit or/and the blower assembly unit, preferably of the heat exchanger assembly unit only, may comprise at least one positioning projection projecting over the sealing surface provided thereon for meshing with a positioning opening of the sealing element.

To guarantee reliable holding of the sealing element, it is proposed that a projection length of the spacer projections be shorter than a projection length of the at least one positioning projection.

The first sealing surface may be provided on a wall of the heat exchanger assembly unit enclosing a combustion chamber assembly unit mounting space.

The blower assembly unit may be designed as a side-channel blower in an advantageous embodiment of the vehicle heater according to the present invention. The second sealing surface may be provided as a sealing surface surrounding a ring-shaped air delivery channel of the blower assembly unit. The air delivery channel may preferably be open at a delivery channel end face that is axially offset in relation to the second sealing surface in the direction of an axis of rotation of a delivery wheel located opposite the delivery channel.

The present invention will be described in detail below with reference to the attached drawings. The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
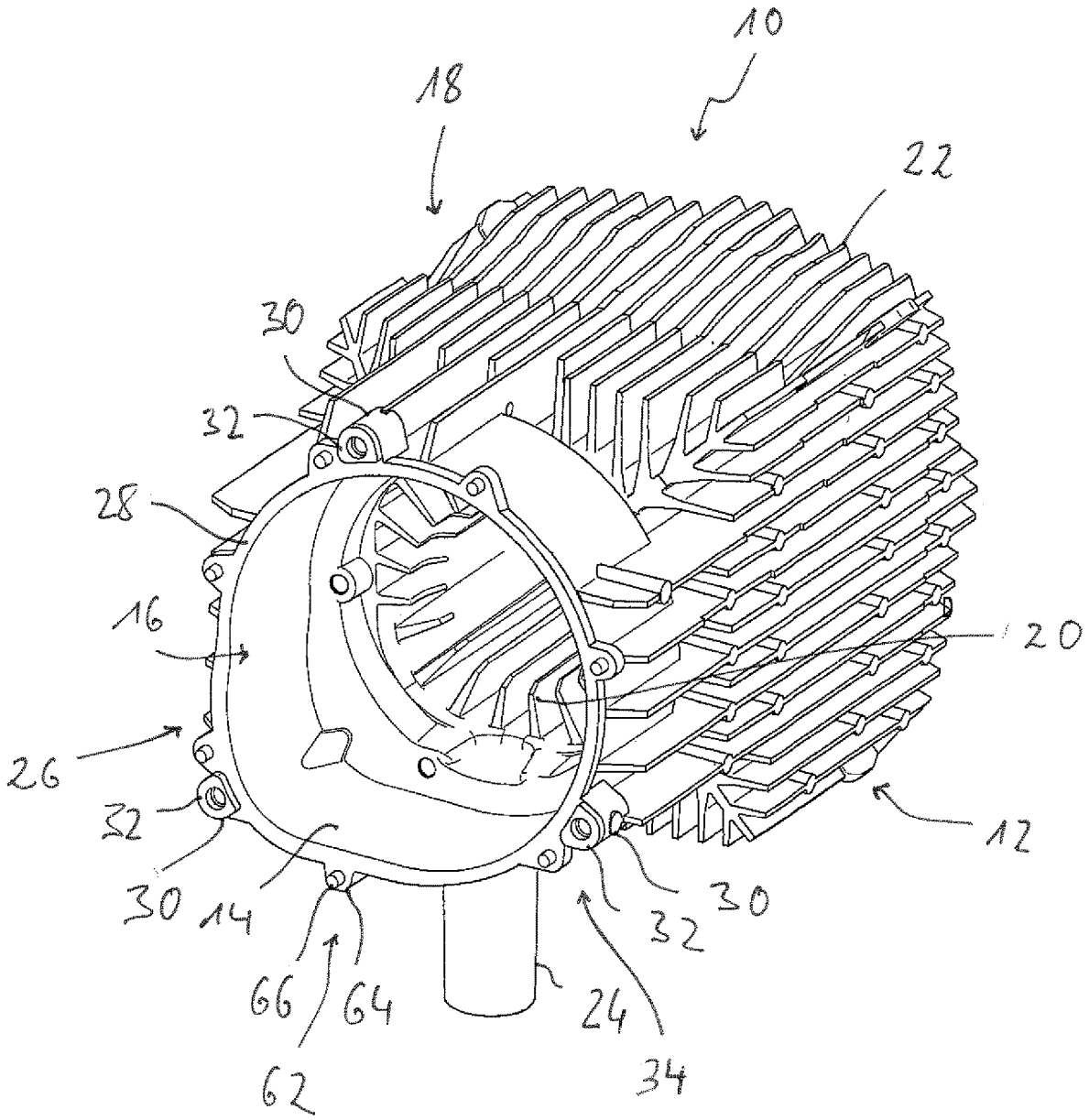
FIG. 1 is a perspective view of a heat exchanger housing of a heat exchanger assembly unit.

Referring to the drawings, FIG. 1 shows a heat exchanger assembly unit 10, which can be used, for example, in a vehicle heater for heating air to be fed into the interior space of a vehicle, as it is known from DE 20 2004 015 442 U1. The heat exchanger assembly unit 10 comprises a heat exchanger housing 12, which is made, in general, of a cast metallic material and which encloses a combustion chamber assembly unit mounting space 16 with an essentially cylindrical circumferential wall 14 in an end area. In a heat exchanger area 18, the heat exchanger housing 12 is provided on a heat exchanger inner side with a plurality of first heat transfer ribs 20 in order to transfer the heat being transported in the combustion waste gases to the heat exchanger housing 12. On a heat exchanger outer side, the heat exchanger housing 12 is provided, especially in the heat exchanger area 18, with a plurality of second heat transfer ribs 22 in order to transfer the heat absorbed in the heat exchanger housing 12 to this air flowing around the heat exchanger housing 12. The combustion waste gases generated in a combustion chamber assembly unit leave the inner space of the heat exchanger housing 12 in the area of an exhaust gas outlet pipe 24.

Figure 4:
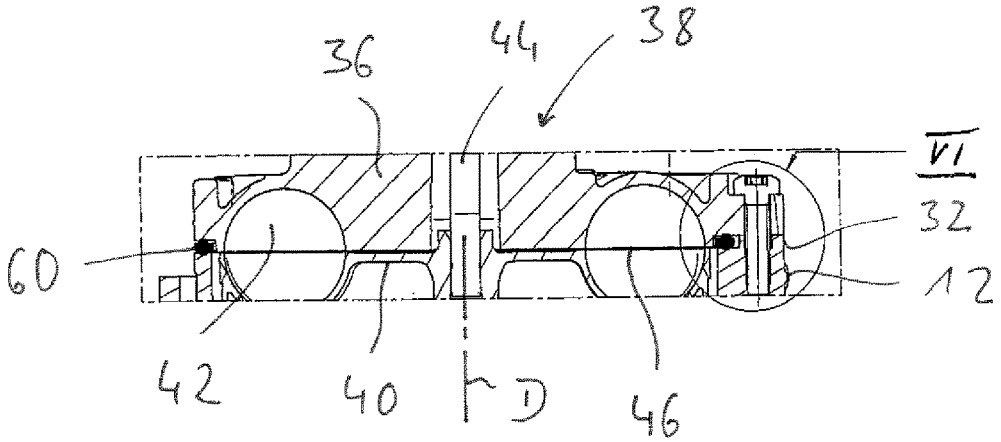
FIG. 4 is a sectional view of the area of the heat exchanger housing according to FIG. 1, which area is connected to a blower assembly unit, along a line IV-IV in FIG. 3.
Figure 5:
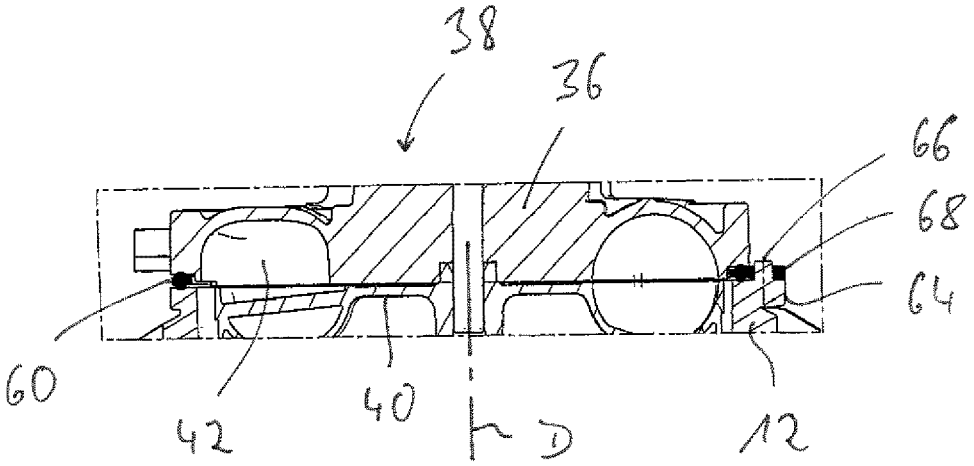
FIG. 5 is a sectional view corresponding to FIG. 4 along a line V-V in FIG. 3.
Figure 6:
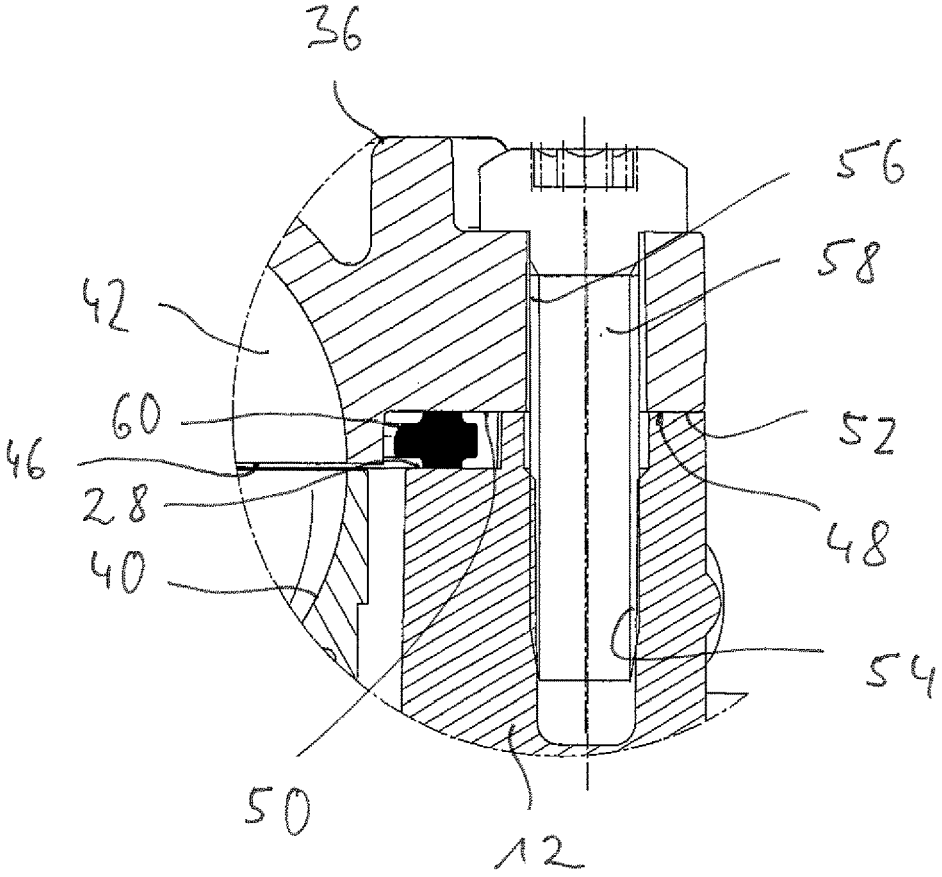
FIG. 6 is an enlarged view of the detail contained in circle VI in FIG. 4.

On an end face 26 provided, for example, in the area of the circumferential wall 14, the heat exchanger housing 12 has a ring-shaped first sealing surface 28. Three spacer/fastening attachments 30 are provided, e.g., as integral components of the heat exchanger housing 12, outside (radially outwardly of) this ring-shaped first sealing surface 28 at circumferentially essentially equally spaced locations. Each of these spacer/fastening attachments 30 has, essentially outside the first sealing surface 28, a spacer projection 32 projecting over (axially outwardly of) the first sealing surface 28. The spacer projections 32 of the three spacer/fastening attachments 30 together form a spacer arrangement 34, by which the heat exchanger housing 12 and a blower housing 36 of a blower assembly unit, which blower housing is shown in FIGS. 4-6 and which blower assembly unit is generally designated by 38, are held at a defined distance from one another. The blower assembly unit 38, designed basically in the manner of a side-channel blower, has in the blower housing 36 a delivery channel 42, which is open in the direction of an axis of rotation D of a delivery wheel 40 and surrounds the axis of rotation D in a ring-shaped manner. The delivery wheel 40 carried on a motor shaft 44 of a blower motor, not shown, for rotation about the axis of rotation D, is located axially opposite the blower housing 36 at a short axial distance on an end face 45 of the blower housing 36 in the area of a delivery channel end face 46. Set back from the heat exchanger assembly unit 10 in the axial direction, a sealing/contact end face 48, which provides a second sealing surface 50 in its radially inner area located close to the delivery wheel 42, is located radially outside the delivery channel end face 46, which delivery channel end face 46 is made with high precision, for example, by finishing by machining, due to the necessary short distance of the delivery wheel 40. The sealing/contact end faces 48 provide contact surfaces 52, with which the spacer projections 32 are in contact in the assembled state, radially outside the second sealing surface 50 and at the same axial level at circumferential positions corresponding to the spacer projections 32.

To ensure that the heat exchanger housing 12 and the blower housing 36 are held together permanently, fastening member meshing openings 54, for example, internally threaded openings, are provided in the spacer/fastening attachments 30. Access openings 56 are provided on the blower hosing 36 in the area of the contact surfaces 52, and fastening members 58, for example, bolts, can be passed through the access openings 56 and can be positioned, i.e., for example, screwed in, such that they mesh with the fastening member meshing openings 54 in the heat exchanger housing 12. In the assembled state shown in an enlarged view in FIG. 6, the first sealing surface 28 and the second sealing surface 50 are located opposite each other at a defined axial distance, and this axial distance corresponds to the projection length of the spacer projections 32 over the first sealing surface 28.

Figure 2:
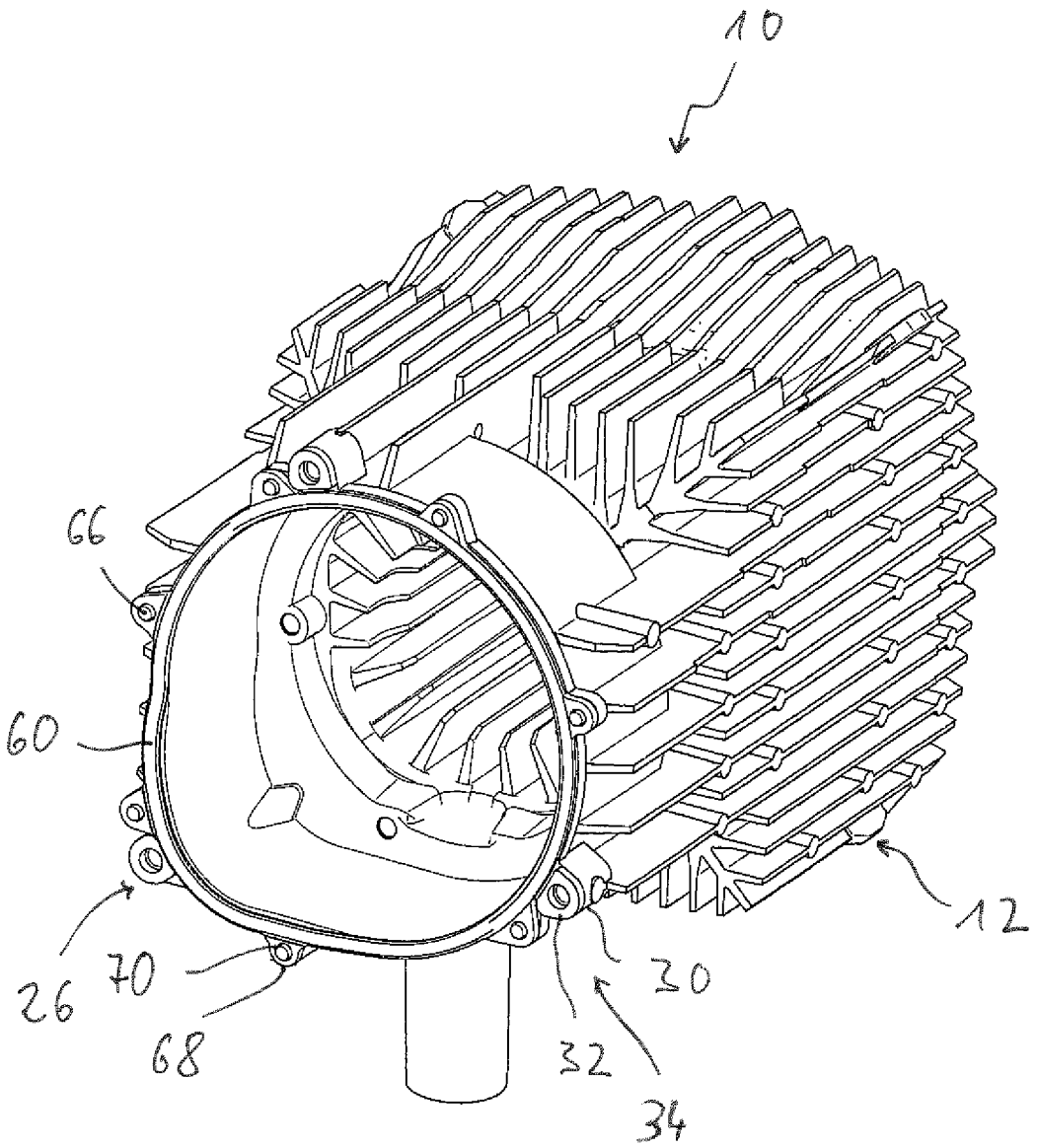
FIG. 2 is a perspective view of the heat exchanger housing corresponding to FIG. 1 with a sealing element positioned at a sealing surface thereof.
Figure 3:
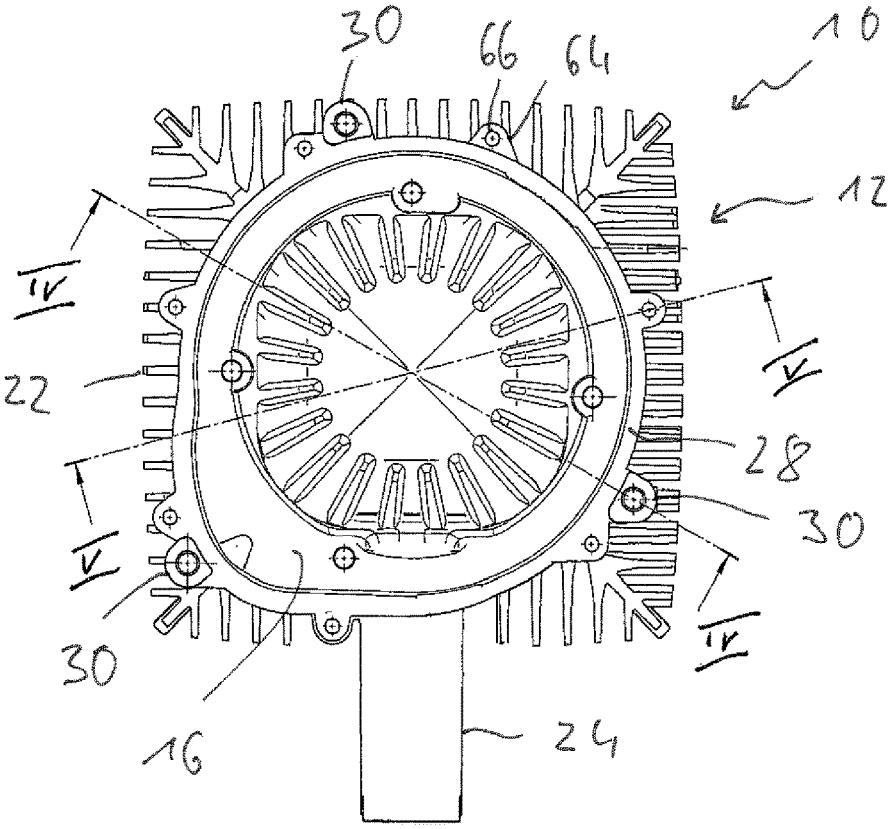
FIG. 3 is a front view of the heat exchanger housing according to FIG. 1.

A ring-shaped sealing element 60 adapted to the ring-like shape of the sealing surfaces 28, 50 is positioned in the intermediate space formed between the sealing surfaces 28, 50 located axially opposite each other. The sealing element 60 shown in contact with the first sealing surface 28 of the heat exchanger housing 12 in FIG. 2 is dimensioned such that the sealing element 60 fills the axial intermediate space between the two sealing surfaces 28, 50, on the one hand, and is compressed, on the other hand, between these two sealing surfaces 28, 50 to provide a tight closure. The cross section of the sealing element 60 may be such that it has a, for example, rectangular central area, on which, for example, semicircular elevated areas project axially on both sides, the semicircular elevated areas being in contact with the first sealing surface 28 and the second sealing surface 50 and being deformed by the axial load. It is ensured by this geometry of the cross section of the sealing element 60 that this element generates a tight closure due to a defined contact interaction with the sealing surfaces 28, 50, on the one hand, and, on the other hand, the sealing element 60 remains positioned between the two sealing surfaces 28, 50, especially where the sealing element 60 is not or cannot be supported in the radially outward direction and will not yield radially outwards. Yielding radially inwards is basically impossible because of the axial offset of the first sealing surface 28 in relation to the end face 46 of the delivery channel.

To preset a defined positioning for the sealing element, especially for the assembly of the blower housing 36 with the heat exchanger housing 12, a sealing element positioning formation 62 is provided. This comprises, radially outside the first sealing surface 28, e.g., as integral parts of the heat exchanger housing 12, radially outwardly projecting attachments 64, on which positioning attachments 66 projecting towards the blower housing 36 over the first sealing surface 28 are formed. Associated with the attachments 64, the sealing element 60 has radially outwardly projecting attachments 68 with positioning openings 70 formed in them. Due to the meshing of the positioning projections 66 with the positioning openings 70, a stable and defined positioning of the sealing element 60 is attained relative to the heat exchanger housing 12. Holding of the sealing element 60 is attained hereby, in particular, in a plurality of, for example, seven circumferential positions.

The sealing element 60 provided in the design of a vehicle heater according to the present invention may be made of a comparatively soft material, for example, an elastomer. Silicone material and elastomer commercially available under the trademark Viton are especially advantageous because of the good heat resistance of these materials.

Since the two sealing surfaces 28, 50, which are to be sealed in relation to one another, are not in contact with one another via the intermediary of a comparatively hard sealing element in the design according to the present invention, which also transmits the connecting forces, but the positioning of the heat exchanger housing 12 in relation to the blower housing 36 is predefined by the spacer projections 32, it is not necessary to manufacture the heat exchanger housing 12, on the one hand, and the blower housing 36, on the other hand, with a high precision, brought about, for example, by machining, in the area of the sealing surfaces 28, 50 thereof. The manufacturing precision arising from a casting method is sufficient in the area of these surfaces. Manufacturing tolerances are compensated by the comparatively thick sealing element 60 made of a readily deformable material.

The blower housing 36 and the heat exchanger housing 12 are advantageously permanently connected to one another in three positions distributed over the circumference, namely, in the area of the spacer/fastening attachments 30, in the design according to the present invention. By providing three connection areas in conjunction with a readily deformable sealing element 60, especially one that does not subject the blower housing 36 to an excessive stress, it is guaranteed that no forces deforming the blower housing 36 will build up. This in turn ensures that the delivery wheel 40 can be positioned at the necessary short distance from the delivery channel end face 46, which is manufactured with high precision.

While specific embodiments of the invention have been shown and described in detail to illustrate the application of the principles of the invention, it will be understood that the invention may be embodied otherwise without departing from such principles.

What is claimed is:

1. A vehicle heater comprising:

a heat exchanger assembly unit with a heat exchanger housing having an axially directed end face providing a ring-shaped first sealing surface;

a blower assembly unit comprising a blower housing with a ring-shaped second sealing surface, positioned axially opposite the first sealing surface, and contact surfaces radially outside the second sealing surface;

a spacer arrangement provided on the heat exchanger assembly unit, the spacer arrangement comprising a plurality of spacer projections provided as integral components of the heat exchanger housing and axially projecting beyond the first sealing surface radially outside the first sealing surface and providing a predefined axial spacing distance between the first sealing surface and the second sealing surface and thereby pre-defining the axial positioning of the heat exchanger assembly unit in relation to the blower assembly unit, and for restricting a contact between the heat exchanger assembly unit and the blower assembly unit to the spacer projections being in contact with the contact surfaces provided on the blower assembly unit;

a sealing element positioning formation provided at the heat exchanger assembly unit and comprising a plurality of positioning projections that are integral parts of the heat exchanger housing and are positioned radially outside the first sealing surface and axially projecting beyond the first sealing surface;

a ring-shaped sealing element clamped between the first sealing surface and the second sealing surface, the sealing element having a plurality of radially outwardly projecting attachments with positioning openings, the positioning projections meshing with the positioning openings of the sealing element;

a fastening member; and a fastening member meshing opening provided in at least one of the spacer projections for meshing with the fastening member for fixing the blower assembly unit at the heat exchanger assembly unit in the predefined axial positioning.

2. The vehicle heater in accordance with claim 1, wherein:

the first sealing surface is provided on an end face of the heat exchanger housing; and the second sealing surface is provided on an end face of the blower assembly unit.

3. The vehicle heater in accordance with claim 1, wherein the blower assembly unit has a sealing/contact end face providing the second sealing surface and a contact surface for each spacer projection.

4. The vehicle heater in accordance with claim 1, wherein a projection length of the spacer projections is shorter than a projection length of the at least one positioning projection.

5. The vehicle heater in accordance with claim 1, wherein:

the heat exchanger housing comprises a wall that encloses a combustion chamber assembly unit mounting space; and the first sealing surface is provided at the wall of the heat exchanger housing or the second sealing surface is provided such that the second sealing surface encloses a ring-shaped air delivery channel of the blower assembly unit or the first sealing surface is provided at the wall of the heat exchanger housing and the second sealing surface is provided such that the second sealing surface encloses a ring-shaped air delivery channel of the blower assembly unit.

6. The vehicle heater in accordance with claim 5, wherein:

the blower assembly unit comprises a delivery wheel located axially opposite the delivery channel; and the air delivery channel is open on a delivery channel end face of the blower assembly unit, which end face is axially offset in relation to the second sealing surface, in a direction of an axis of rotation of the delivery wheel.

7. A vehicle heater comprising:

a heat exchanger assembly unit with a heat exchanger housing having an axially directed end face providing a ring-shaped heat exchanger unit sealing surface;

a blower assembly unit with a ring-shaped blower assembly unit sealing surface positioned axially opposite said heat exchanger unit sealing surface and with contact surfaces radially outside the blower assembly unit sealing surface;

a spacer arrangement comprising spacer projections disposed radially outwardly of said blower assembly unit sealing surface and radially outwardly of said heat exchanger unit sealing surface and provided as an integral component of said heat exchanger housing, axially projecting beyond the heat exchanger unit sealing surface and disposed radially outside the heat exchanger unit sealing surface to establish a predefined axial spacing between said blower assembly unit sealing surface and said heat exchanger unit sealing surface for thereby predefining an axial positioning of the heat exchanger assembly unit in relation to the blower assembly unit to provide a predefined axial position of the blower assembly unit, and for restricting a contact between the heat exchanger assembly unit and the blower assembly unit to the spacer projections being in contact with the contact surfaces provided on the blower assembly unit in association therewith;

a sealing element between said blower assembly unit sealing surface and said heat exchanger unit sealing surface, said sealing element having a plurality of radially outward projecting attachments with positioning openings;

a sealing element positioning formation provided at said heat exchanger assembly unit, said sealing element positioning formation comprising, at said heat exchanger assembly unit, a plurality of positioning projections formed integral with the heat exchanger housing and positioned radially outside the heat exchanger unit sealing surface and axially projecting beyond said heat exchanger unit sealing surface; and a clamping arrangement to apply a clamping force from said blower assembly unit sealing surface and said heat exchanger unit sealing surface to said sealing element to clamp said sealing element between said blower assembly unit sealing surface and said heat exchanger unit sealing surface, wherein:

said blower assembly unit sealing surface is provided on an end face of a blower housing of said blower assembly unit;

said clamping arrangement comprises a fastening member and a fastening member engaging opening in at least one of said spacer projections for engaging with said fastening member and fixing said blower assembly unit at said heat exchanger assembly unit in the predefined axial position of the blower assembly unit;

said positioning projections engage with the positioning openings of said sealing element; and a projection length of said spacer projections is shorter than a projection length of said positioning projections.

8. The vehicle heater in accordance with claim 7, wherein said blower assembly unit has a sealing/contact end face providing said blower assembly unit sealing surface and the contact surface for each of said spacer projections.

9. The vehicle heater in accordance with claim 7, wherein:

said heat exchanger housing comprises a wall that encloses a combustion chamber assembly unit mounting space; and said heat exchanger unit sealing surface is provided at said wall of said heat exchanger housing or said blower assembly unit sealing surface encloses a ring-shaped air delivery channel of said blower assembly unit or said heat exchanger unit sealing surface is provided at said wall of said heat exchanger housing and said blower assembly unit sealing surface encloses a ring-shaped air delivery channel of said blower assembly unit.

10. The vehicle heater in accordance with claim 9, wherein:

said blower assembly unit comprises a delivery wheel located axially opposite said delivery channel; and said air delivery channel is open on a delivery channel end face of said blower assembly unit, said end face being axially offset in relation to said blower assembly unit sealing surface, in a direction of an axis of rotation of said delivery wheel.

* * * * *